US006974087B2

(12) United States Patent
Faichney

(10) Patent No.: US 6,974,087 B2
(45) Date of Patent: Dec. 13, 2005

(54) RAILWAY TIE PLATE

(75) Inventor: John Faichney, Mississauga (CA)

(73) Assignee: MSR Rail Products Inc., Mississauga (CA)

( * ) Notice: Subject to any disclaimer, the term of this patent is extended or adjusted under 35 U.S.C. 154(b) by 0 days.

(21) Appl. No.: 10/352,136

(22) Filed: Jan. 28, 2003

(65) Prior Publication Data

US 2004/0144851 A1 Jul. 29, 2004

(51) Int. Cl.[7] ..... E01B 3/12
(52) U.S. Cl. ..... 238/287; 238/306; 238/264
(58) Field of Search ..... 238/287, 280, 238/349, 297, 306, 304, 310, 315, 351, 264, 238/338, 308

(56) References Cited

U.S. PATENT DOCUMENTS

| | | | | |
|---|---|---|---|---|
| 522,867 | A * | 7/1894 | Wilson | 238/297 |
| 911,230 | A * | 2/1909 | Goldie, Jr. | 238/297 |
| 4,108,378 | A * | 8/1978 | Raymond | 238/298 |
| 4,155,507 | A * | 5/1979 | Chierici et al. | 238/287 |
| 4,349,151 | A * | 9/1982 | Schumaker | 238/349 |
| 4,479,607 | A * | 10/1984 | Okumura et al. | 238/349 |
| RE32,894 | E * | 3/1989 | Gragnami | 238/304 |
| 6,308,897 | B1 * | 10/2001 | Remington et al. | 238/292 |
| 6,431,463 | B2 * | 8/2002 | Igwemezie | 238/264 |

OTHER PUBLICATIONS

Track Yearbook, 2001-2002, Description of Tie Plates.

* cited by examiner

*Primary Examiner*—Frantz F. Jules
(74) *Attorney, Agent, or Firm*—Gowling Lafleur Henderson LLP; Peter Milne

(57) ABSTRACT

A tie plate is provided for securing a rail to a railway tie. The tie plate has a base with a tie face opposite a rail face, opposite end faces extending between the tie and the rail faces, a gauge side opposite a field side with said gauge and field sides extending between the opposite end faces and the rail and tie faces. A rail support section runs across the rail face between the opposite end faces and along the gauge and field sides. The tie plate further has a respective clip hold down housing adjacent the rail support section on the field side and the gauge side, each clip hold down housing having a rail abutting face proximal the rail support section and a longitudinally extending receptacle for receiving a spring clip. A respective rail locating shoulder extends from the rail face on either side of the rail support section. Locating ridges extend from the tie face for embedding into a tie. Screw holes extend through the tie plate between the rail and tie faces on the field side and on the gauge side for receiving lag screws to secure the tie plate to the tie. At least one spike hole extends through the tie plate between the tie face and the rail face on each of the field side and the tie side.

7 Claims, 3 Drawing Sheets

RAILWAY TIE PLATE

FIELD OF THE INVENTION

This invention relates generally to railroad fixtures and more specifically to tie plates for securing rails to railroad ties.

BACKGROUND OF THE INVENTION

A railroad generally consists of a pair of longitudinally running steel rails mounted to transversely extending rail ties. The rail ties maintain the pair of rails a set distance apart, referred to as the "gauge". The ties are embedded in crushed stone or slag to resist shifting of the rails as trains are run therealong.

The rails are mounted to the ties by securing brackets referred to as "tie plates". A basic tie plate is a substantially flat rectangular member with a shallow channel extending across it to receive the lower flange of a rail. The bracket has holes extending through it adjacent the channel to receive spikes. The spikes are driven through the holes in the tie plates into an underlying tie, with the head of the spike extending over the edges of the lower flange of the rail, to secure the rail to the tie.

The conventional tie plates are reasonably effective for straight runs and fresh ties. A principal disadvantage with conventional tie plates is that they rely on spikes for securement. With continued passage of trains and weathering, the spikes eventually work out of their respective holes and the ties become "spike killed" as new spikes are not securely received by the worn-out holes.

Furthermore, in corners the lateral force of a train passing over the rails will cause lateral movement of the rails and the rails to become spaced apart further and the "gauge to widen".

To provide more secure mounting of rails in corners, a different tie plate arrangement has been developed such as for example sold under the trademark PANDROL. These plates are secured to the tie by lag screws (sometimes referred to as "screw spikes"). The rails are held to the plates by spring clips which engage a receptacle in the tie plate and which extend over the lower flange of the rail.

Screw secured plates do provide significantly better securement than spike secured plates however suffer from the disadvantage that they are significantly more time consuming and labour intensive to install. A spike secured plate may be spiked in place by an automated spiking machine that runs along the track. A screw secured tie plate must have each lag screw individually installed by a rail crew and requires installation of the spring clips to secure the rail to the tie plate.

Installation time requirements are very important in the railway industry. Shorter installation times minimize disruption to rail schedules by requiring a smaller "window" of track downtime. Furthermore, a typical rail crew has about 25 persons. Prior art screw secured plates are slower to install than spike secured plates and the time required for a few crew members to install the screws delays the remainder of the crew therefore adding to installation costs.

In the event of derailment, screw secured tie plates are generally rendered unserviceable. This is because the wheels of any derailed cars strike the spring clips and that portion of the tie plate which retains the spring clips. This renders the spring clips unserviceable and the tie plates incapable of receiving new spring clips.

Conventional screw secured tie plates are useable only with No. 1 ties as the spacing between screw holes does not enable a secure installation on arrower No. 2 ties.

It is an object of the present invention to provide a rail tie plate which has the resistance to movement of a screw secured tie plate yet which may be installed, at least temporarily, at a rate similar to that of a spike secured tie plate.

It is a further object of the present invention to provide a screw securable tie plate which is securely attachable to both No. 1 and No. 2 ties.

SUMMARY OF THE INVENTION

A tie plate is provided for securing a rail to a railway tie. The tie plate has a base with a tie face opposite a rail face, opposite end faces extending between the tie and the rail faces, a gauge side opposite a field side with said gauge and field sides extending between the opposite end faces and the rail and tie faces. A rail support section runs across the rail face between the opposite end faces and along the gauge and field sides. The tie plate further has a respective clip hold down housing adjacent the rail support section on the field side and the gauge side, each clip hold down housing having a rail abutting face proximal the rail support section and a longitudinally extending receptacle for receiving a spring clip. A respective rail locating shoulder extends from the rail face on either side of the rail support section. Locating ridges extend from the tie face for embedding into a tie. Screw holes extend through the tie plate between the rail and tie faces on the field side and on the gauge side for receiving lag screws to secure the tie plate to the tie. At least one spike hole extends through the tie plate between the tie face and the rail face on each of the field side and the tie side.

A pair of screw holes may extend through the tie plate on each of the gauge side and the field side. The pair of screw holes may be spaced apart by a distance that enables lag screws to be inserted through the tie plate into a No. 2 tie.

The spike holes are preferably positioned to locate a head of a spike so as to overlap the rail support section to secure a lower web of a rail to the tie plate.

Each clip hold down housing is preferably adjacent a respective of the end faces to permit the clips to overhang the respective end face during clip installation and avoid interference between the tie plate and a clip installing tool.

The rail support section may have a rail side face opposite the tie face of the tie plate. The rail side face may be downwardly inclined toward the gauge side. Furthermore the locating ridges may be profiled to preferentially prevent movement of the rail tie plate toward the field side.

The tie plate may have markings thereon to indicate the rail side and the field side.

DESCRIPTION OF DRAWINGS

Preferred embodiments of the present invention are described below with reference to the accompanying drawings in which.

DETAILED DESCRIPTION OF PREFERRED EMBODIMENTS

Figure 1:
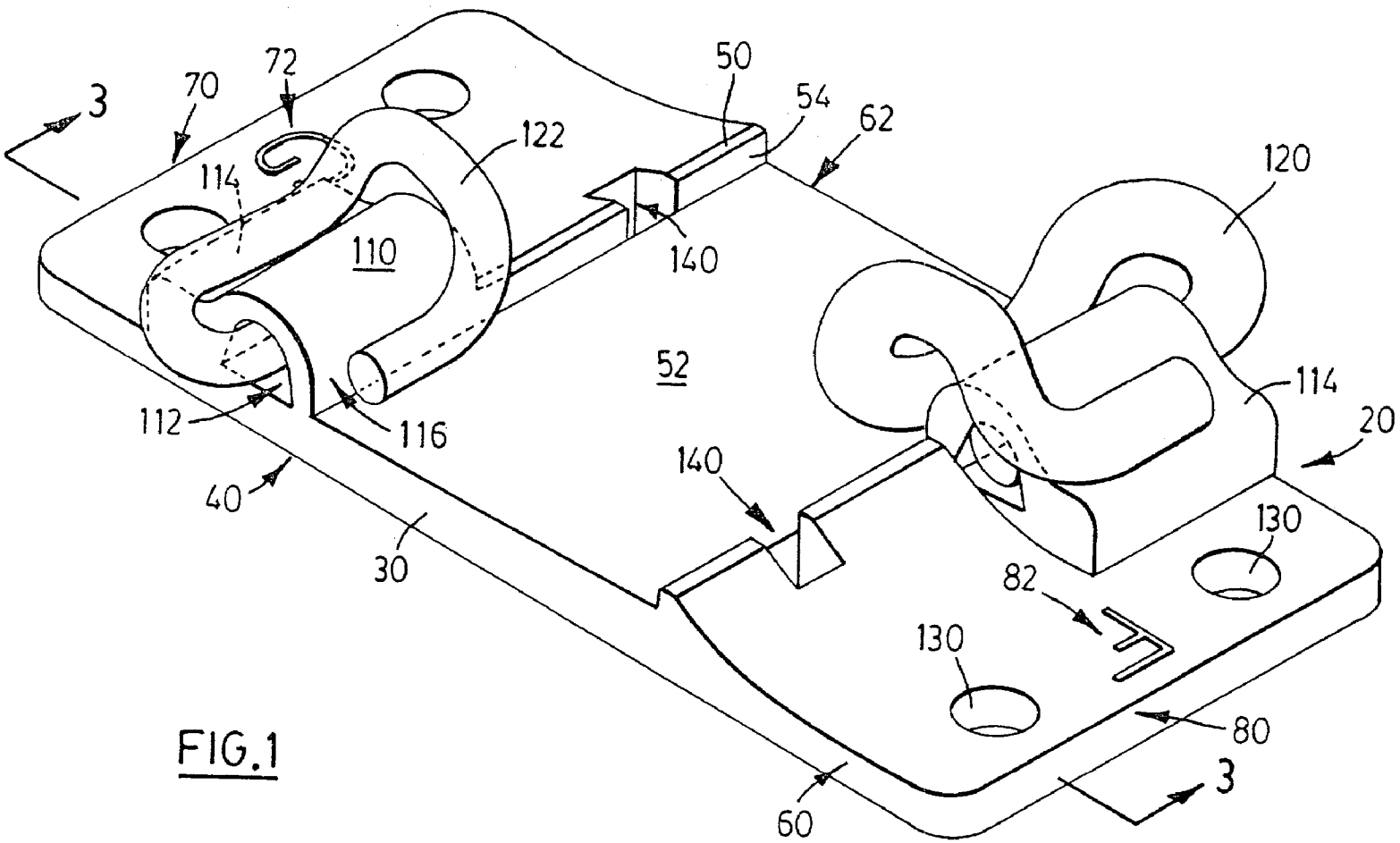
FIG. 1 is perspective view from above of a tie plate according to the present invention.
Figure 2:
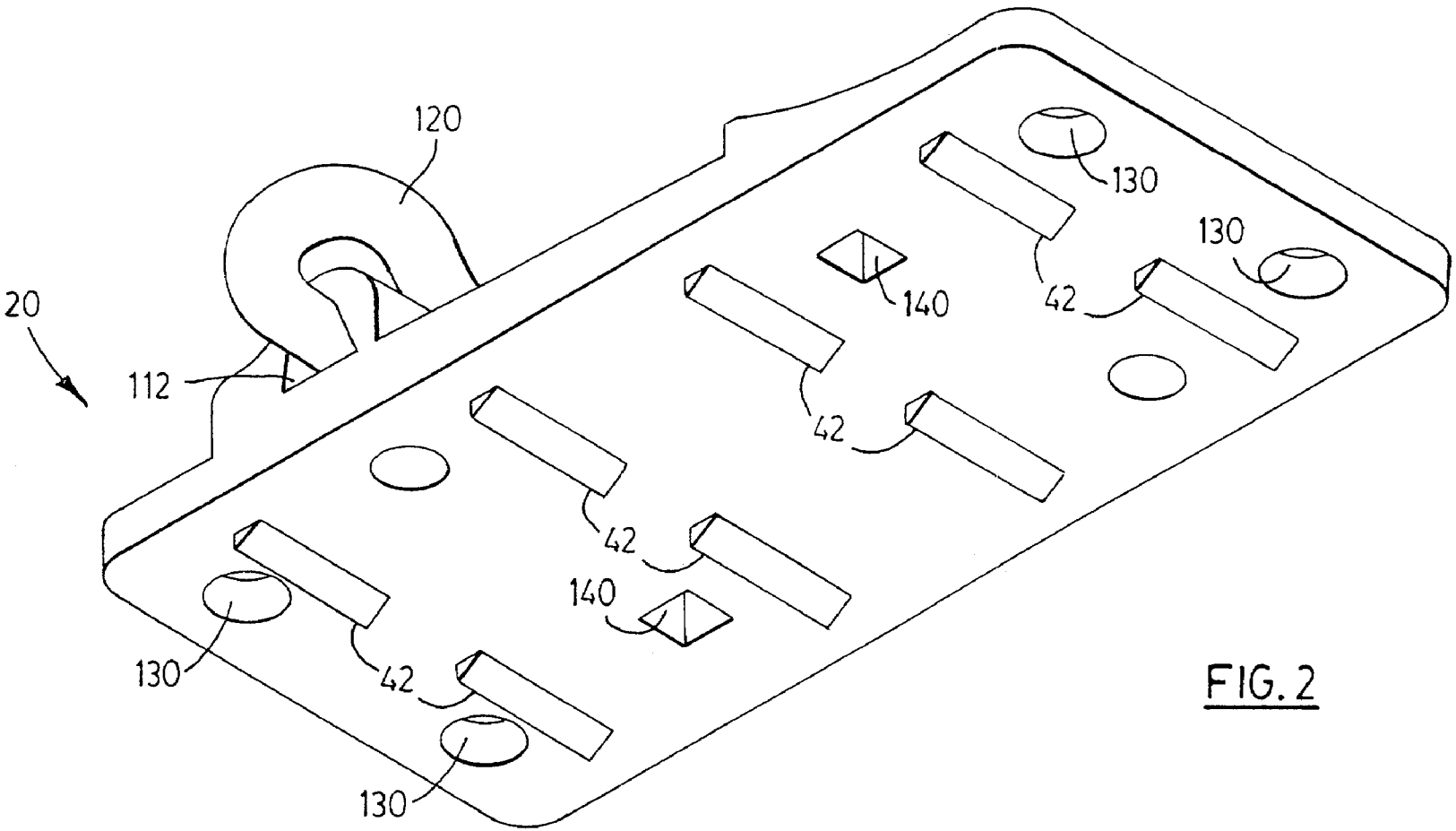
FIG. 2 is a perspective view from below of the tie plate of FIG. 1; and, FIG. 3 is a section on line 3—3 of FIG. 1 illustrating a section of rail secured by a tie plate according to the present invention on a railroad tie.
Figure 3:
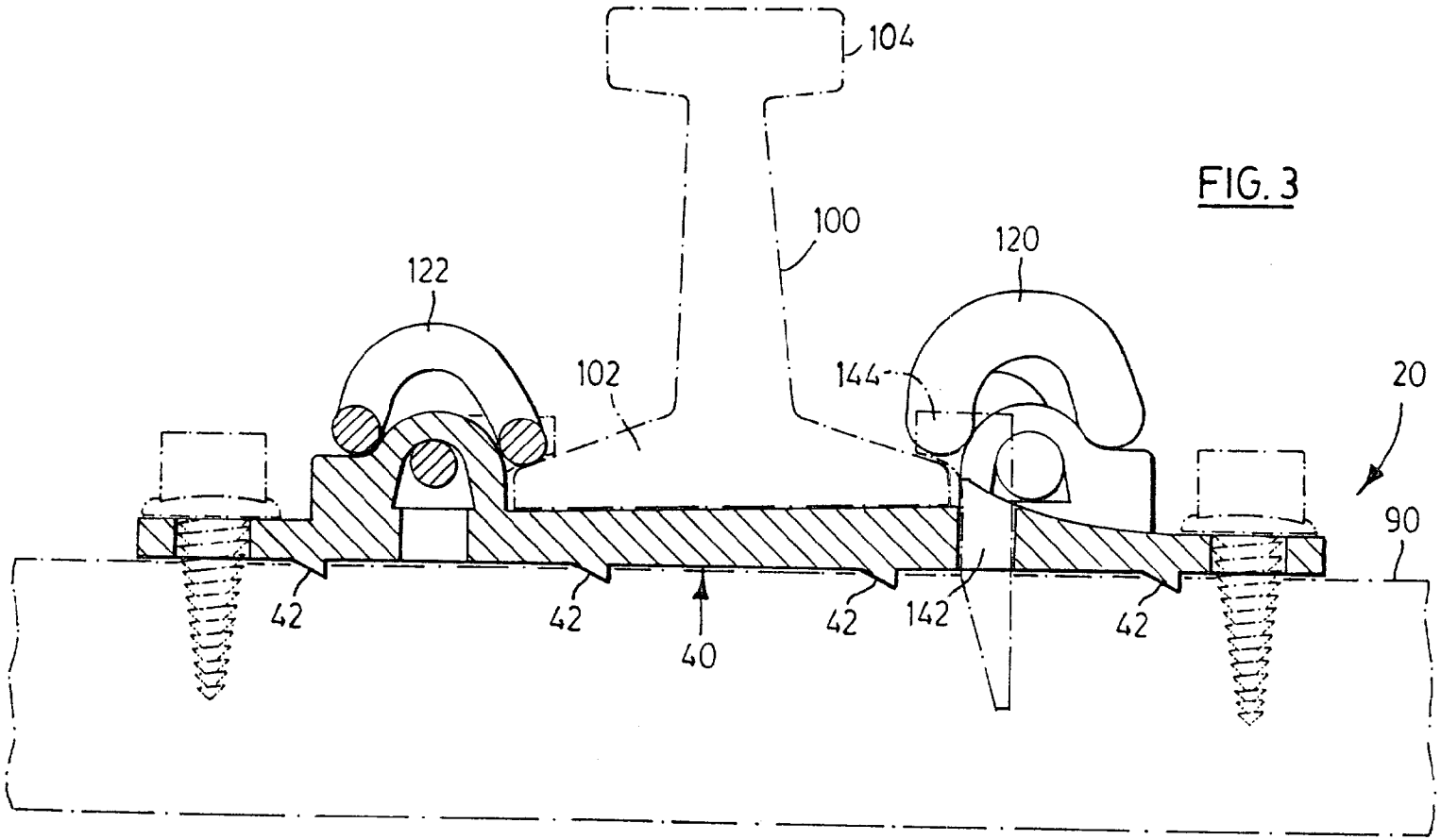

A tie plate according to the present invention is generally indicated by reference 20 in the accompanying illustrations. The tie plate 20 has a base 30 with a tie face 40 opposite a rail face 50. Opposite end faces 60 and 62 extend between the tie face 40 and rail face 50.

The tie plate 20 further has a gauge side 70 and a field side 80. The gauge and field sides, 70 and 80 respectively, extend between the opposite end faces 60 and 62 and between the tie face 40 and rail face 50.

In use, the tie face 40 would abut a tie 90. The rail face would support a rail 100. The gauge side 70 would face toward the space between adjacent rails and the field side 80 would face-away from the adjacent rails.

The rail face 50 has a rail support section 52 running thereacross between the opposite end faces 60 and 62 and generally parallel to, or along the gauge side 70 and the field side 80.

The tie plate 20 has a respective clip hold down housing 110 adjacent the rail support section 52 on the field side 80 and the gauge side 70. Each clip hold down housing has a rail abutting face 116 proximal the rail support sections. Each clip hold down housing 110 has a receptacle 112 extending longitudinally into it from the adjacent of the respective end faces 60 and 62 for receiving an end of a spring clip 120 or 122. The housings 110 further have an abutment 114 for the spring clip 120 to abut against and limit non-resilient rotation of the spring clip 120 away from the rail support section 52.

Two spring clip designs are illustrated in the drawings, these are exemplary and other designs are no doubt workable. A first type 120 is a higher duty clip with a lower holding force than the clip 122. The clip hold down housings 110 may advantageously, as illustrated be substantially flush with the end faces 60 and 62 so that the clips 120 and 122 overhang the end faces 60 and 62 during installation of the clips 120 or 122. This enables a "clear shot" at the clip with a sledge hammer or other insertion tool without interference from the tie plate 20.

A respective rail locating shoulder 54 extends from the rail face 50 on either side of the rail support section 52. The shoulder 54 and an inner face 116 of the clip hold down housings 110 lie against the edges of a lower flange 102 of the rail 100 to restrict lateral movement of the rail 100. Preferably the rail 100 will be laterally supported along the full length of the rail support section 52 to minimize wear between the tie plate 20 and the lower flange 102 of the rail 100. For securement of the tie plate 20 to the tie 90, both screw holes 130 and spike holes 140 are provided. Two screw holes 130 are provided on each of the field side 80 and the gauge side 70 through the tie plate 20 between the rail face 50 and the tie face 40. Preferably the screw holes 130 are spaced apart by an amount that will enable securement to either a No. 1 tie or a No. 2 tie. A spacing of 4 inches (about 10.2 cm) between the centers of the screw holes 130 has been found to achieve this purpose. It is expected that a spacing of from 3½ inches to 6 inches would work to achieve this.

The spike holes 140, of which only one is necessary on each of the field side and the gauge side extend through the shoulders 54 to locate a spike 142 with its head 144 overlapping the lower flange 102 of the rail 100. The tie plate 20 can therefore be spike secured at least as an initial installation with subsequent screw securement at a more convenient time.

By way of example, should a repair be required, a crew could relatively quickly spike secure the tie plates 20 and the rails 100 to enable rail traffic to pass or the principal crew to move on to a different installation. A separate much smaller screw, such as 3 or 4 persons could return subsequently at a more convenient time to install the lag screws and spring clips. The initial spiking could be carried out with automatic spiking equipment.

The tie face 40 may, as illustrated have locating ridges 42 extending therefrom. The ridges 42 may have a triangular or other profile to facilitate embedding of the ridges 42 into the ties 90 to resist lateral movement.

As forces tending to cause lateral movement will typically be unidirectional, namely radially outwardly, the ridges may be profiled with a shape that preferentially resists movement in that direction. A suitable shape to accomplish this would for example, as illustrated, be a right triangle.

It is common practice in the railway industry to provide a slight inclination of the rails 100 to minimize rail wear through rollover of the upper flange 104. This is generally accomplished by providing a slight incline to the rail support section 52 leaning from the field side 80 toward the gauge side 70. As the incline is relatively small, typically on the order of 1:40, it is helpful to provide markings such as reference 72 and 82 to respectively indicate the gauge side and the field side. The markings 72 and 82 make the gauge side 70 and field side 80 easier to discern.

The above description is intended in an illustrative rather than a restrictive sense. Variations to the exact description may be apparent to those skilled in the relevant art without departing from the spirit and scope of the invention as defined by the claims set out below.

What is claimed is:

1. A tie plate for securing a rail to a railway tie, said tie plate comprising:

a base having a tie face opposite a rail face;

opposite end faces extending between said tie and said rail faces;

a gauge side opposite a field side, said gauge and field sides extending between said opposite end faces and said rail and said tie faces;

a rail support section running across said rail face between said opposite end faces and along said gauge and said field sides;

a respective clip hold down housing adjacent said rail support section on said field side and said gauge side, each said clip hold down housing having a rail abutting face proximal said rail support section and a longitudinally extending receptacle for receiving a spring clip for securing said rail to said tie plate;

a respective rail locating shoulder extending from said rail face on either side of said rail support section;

locating ridges extending from said tie profiled to pierce said tie face for embedding into an ungrooved surface of said tie;

screw holes extending through said tie plate between said rail and said tie faces on said field side and on said gauge side for receiving lag screws to secure said tie plate to said tie; and, at least one spike hole extending through said tie plate between said tie face and said rail face on said field side and on said tie side.

2. A tie plate as claimed in claim 1 wherein:

said spike holes are positioned to locate a head of a spike so as to overlap said rail support section to secure a lower web of the rail to said tie plate.

3. A tie plate as claimed in claim 2 wherein:

a pair of said screw holes extends through said tie plate on each said gauge side and said field side, said pair of said screw holes being spaced apart by a distance that enables lag screws to be inserted through said tie plate into at least a No. 2 tie.

4. A tie plate as claimed in claim 3 wherein:

each said clip hold down housing is adjacent a respective of said opposite end faces to permit said clips to overhang said respective end faces during clip installation and avoid interference between said tie plate and a clip installing tool.

5. A tie plate as claimed in claim 4 wherein:

said rail support section has a rail side face opposite said tie face of said tie plate;

said rail side face is downwardly inclined toward said gauge side; and, said locating ridges are profiled to preferentially prevent movement of said tie plate toward said field side.

6. The tie plate of claim 5 wherein:

said tie plate has markings thereon to indicate said rail side and said field side.

7. The tie plate of claim 3 wherein:

said distance between said screw holes is from 3½ inches to 6 inches on center.

* * * * *